US007356272B2

(12) United States Patent
Yamada et al.

(10) Patent No.: US 7,356,272 B2
(45) Date of Patent: Apr. 8, 2008

(54) IMAGE FORMING APPARATUS WITH DEVELOPING ROLLER THAT ROTATES DURING STANDBY TO ENSURE TONER UNIFORMITY

(75) Inventors: Yoichi Yamada, Nagano (JP); Keiichi Taguchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 219 days.

(21) Appl. No.: 11/258,623

(22) Filed: Oct. 24, 2005

(65) Prior Publication Data

US 2006/0098998 A1 May 11, 2006

(30) Foreign Application Priority Data

Oct. 29, 2004 (JP) ..... P2004-315565
Oct. 29, 2004 (JP) ..... P2004-315566
Oct. 29, 2004 (JP) ..... P2004-315567

(51) Int. Cl.
*G03G 15/08* (2006.01)

(52) U.S. Cl. ..... 399/53

(58) Field of Classification Search ..... 399/53, 399/60, 222

See application file for complete search history.

(56) References Cited

U.S. PATENT DOCUMENTS 7,068,957 B2 * 6/2006 Shimura et al. ..... 399/49
7,251,423 B2 * 7/2007 Shimura et al. ..... 399/49

FOREIGN PATENT DOCUMENTS

| | | |
|---|---|---|
| JP | 2002-351190 | 12/2002 |
| JP | 2003-316106 | 11/2003 |
| JP | 2004-126089 | 4/2004 |

OTHER PUBLICATIONS

Computer translation of Arai, JP2004-126089a.*

* cited by examiner

*Primary Examiner*—Quana Grainger
(74) *Attorney, Agent, or Firm*—Hogan & Hartson LLP

(57) ABSTRACT

An electrostatic latent image associated with image data is formed on an image carrier. A developer includes a container containing toner a roller facing the image carrier and causing the toner to adhere onto the image carrier to develop the electrostatic image with the toner as a image, and an applier applying the toner to the roller. A controller is operable to receive the image data and to control the roller in correspondence to the image data. The image data includes first image data corresponding to a first image and second image data corresponding to a second image. The first image is formed onto a trailing end portion of the medium. The controller receives the second image data after the formation of the first image. After the formation of the first image and before the formation of the second image, the controller causes the roller to rotate without causing the toner to adhere onto the image carrier.

15 Claims, 7 Drawing Sheets

IMAGE FORMING APPARATUS WITH DEVELOPING ROLLER THAT ROTATES DURING STANDBY TO ENSURE TONER UNIFORMITY

BACKGROUND OF THE INVENTION

The present invention relates to an image forming apparatus, specifically relates to an image forming apparatus capable of forming a high quality image from beginning to restart to form an image.

There is known an image forming apparatus of an electronic photography recording system for exposing to form an electrostatic latent image on a surface of an image carrier executed by a photosensitive member, and according to the image forming apparatus, an image is formed by transferring a toner image onto a record medium such as a record sheet or the like. A developing roller opposed to the surface of the image carrier rotates to cause toner on an outer peripheral face thereof adhere to the surface of the image carrier to develop the electrostatic image as the toner image. The developing roller is supplied with the toner by bringing a supply roller rotated in a space that contains the toner into press contact with the developing roller to rotate.

The image forming apparatus adopting the electronic photography recording system is insertably and detachably mounted with a developing cartridge (developer) having a container containing the toner along with the developing roller and the supply roller, and there is also present an apparatus constituted to be able to contain a plurality of the developing cartridges at inside of a developing rotary unit. According to the image forming apparatus, the developing cartridge at a developing position at which the developing roller is made to be opposed to the image carrier can be switched by rotating the developing rotary unit centering a rotating shaft.

According to the image forming apparatus, as the developing cartridge for adhering the toner to the surface of the carrier, by constituting to enable to mount the developing cartridges respectively containing toners of yellow (Y), magenta (M), cyan (C), black (K) to the developing rotary unit, a color image overlapped with the respective colors can be formed by successively switching the developing cartridges (refer to, for example, JP-A-2004-126089). Further, according to the constitution, a monochrome image by a single color of an image, for example, a black and white monochrome image (hereinafter, also simply referred to as a monochrome image) by the toner of black (K) can naturally be formed. According to the constitution in which the plurality of developing cartridges contain the toner of the same color (mainly black), by successively switching the developing cartridges used by rotating the rotary unit at each timing of using up the toner or the like, the monochrome image can be realized to continue to form over a long period of time by reducing a number of times of operation of replenishing the toner by interchanging the developing cartridges (refer to, for example, JP-A-2002-351190 and JP-A-2003-316106).

However, according to the image forming apparatus, when a standby time period after finishing an image forming operation is long to some degree and the developing roller is left to stay in a state in which the developing roller is not rotated, on the outer peripheral face of the developing roller, a difference is brought about in a state of the toner on the outer peripheral face between a region thereof in which the toner is exposed to outside as being opposed to the surface of the image carrier and a region thereof in which the toner is disposed at inside of the container of the developing cartridge. Therefore, when a successive image forming operation is restarted, there is brought about nonuniformity in density in correspondence with the exposed region in which the toner is exposed to outside and the region at inside of the container, in other words, the nonuniformity in density coinciding with a rotating period of the developing roller, and there is a possibility of occurring a problem in an image quality.

In order to resolve the problem, according to JP-A-2004-126089, it is proposed to put the toner on the outer peripheral face of the developing roller to a uniform quality by counting a time period elapsed from an end time of the image forming operation at a preceding operation and idly rotating the developing roller to refresh when the elapsed time period becomes equal to or longer than a set time period.

According to the image forming apparatus described in JP-A-2004-126089, it has been found that although deterioration in the image quality by a longish standby time period can be realized to resolve, it is preferable to constitute a countermeasure therefor even when the standby time period is a short time period.

First, by charging the developing roller while repeatedly supplying the toner onto the outer peripheral face of the developing roller by the supply roller rotated at inside of the developing cartridge, the developing operation of adhering the toner to the electrostatic latent image on the surface of the image carrier is continued and therefore, the toner on the outer peripheral face is brought into a state of being saturated by a desired charge voltage.

The toner on the outer peripheral face of the developing roller is selectively adhered to the electrostatic latent image on the surface of the image carrier and therefore, the nonuniformity is occurred by whether the adhered portion is the portion in correspondence with the electrostatic latent image on the surface of the image carrier and a new toner is replenished to resolve the nonuniformity. At this occasion, the toner to be replenished is present at a surrounding of the supply roller and therefore, during a time period of repeating the developing operation, there is brought about a charged state which is more proximate to the toner on the outer peripheral face of the developing roller than the toner exposed at a position quite remote therefrom. Therefore, the electrostatic latent image on the surface of the image carrier can be developed by a uniform quality by bringing the developing roller into a uniform state by repeatedly replenishing a toner on the outer peripheral face.

However, in carrying out the final developing operation, when the operation is stopped in a state in which there is the nonuniformity of the toner on the outer peripheral face of the developing roller, there is brought about a difference between a state of the toner left on the outer peripheral face and a state of the toner replenished to resolve the nonuniformity on the outer peripheral face of the developing roller when the developing operation is restarted in forming a successive image. That is, it is conceived that whereas the toner on the outer peripheral face of the developing roller opposed to the surface of the image carrier is left in an electrically floated state, the toner at inside of the developing cartridge is brought into a state in which a large amount of the other toner is present at a surrounding and therefore, even when the toner is left in a short period of time, there is brought about a difference therebetween in a degree of charging. Under the state, even when the developing operation is restarted, the electrostatic latent image on the surface of the image carrier cannot be developed by the uniform quality owing to the toner on the outer peripheral face of the developing roller.

The nonuniformity of the toner tends to differ in characteristics in accordance with kinds of toners having different colors, among toners of yellow, magenta, cyan, black, particularly, the toner of black having a high frequency of continuously printing the monochrome single color image includes carbon and is excellent in conductivity and therefore, the toner of black is more liable to be the nonuniform than the toner of other colors and it seems that the more increased the content of carbon, the more significant the nonuniformity.

Owing to the difference in the conductive characteristic, the charge voltage of the toner of black differs from that of the toner of other colors and it is necessary to rotate the developing roller more than in the case of the toner of other colors until saturating the charge voltage. Therefrom, in the case of the toner of black, a number of rotations of the developing roller necessary for resolving the nonuniform of the toner tends to increase such that whereas the number may be one rotation in the case of the toner of other colors, in the case of the toner of black, it is preferable to rotate the developing roller more than two rotations.

Here, although as a plan for preventing the nonuniformity of the toner from occurring, it is conceivable to increase a charge efficiency (voltage) of the toner on the outer peripheral face of the developing roller, when the charge voltage is indiscreetly increased, developing performance is deteriorated in an image of the nonuniformity in density or the like.

Further, the possibility of bringing about the nonuniform of the toner is changed by the charge characteristic of the toner and therefore, the nonuniform is liable to be brought about by other factor of temperature or humidity of a surrounding environment, further, a degree of deteriorating the toner or the like.

SUMMARY

It is an advantage of the invention to provide an image forming apparatus capable of forming a high quality image by putting a toner on an outer peripheral face of a developing roller into uniform from the start in restarting to form an image even when a standby time period is short.

According to the present invention, there is provided:

an image forming apparatus forming an image corresponding to image data on a medium being transported, the image forming apparatus comprising:

an image carrier on which an electrostatic latent image associated with the image data is formed;

a developer comprising:

a container containing toner;

a roller facing the image carrier and causing the toner to adhere onto the image carrier to develop the electrostatic image with the toner as the image; and an applier applying the toner to the roller; and a controller operable to receive the image data and to control the roller in correspondence to the image data, wherein the image data includes first image data corresponding to a first image and second image data corresponding to a second image, the first image is formed onto a trailing end portion of the medium, the controller receives the second image data after the formation of the first image, and after the formation of the first image and before the formation of the second image, the controller causes the roller to rotate without causing the toner to adhere onto the image carrier.

According to an aspect of the invention, when the image is finally formed on the trailing end side of the medium before shifting to a standby state, after finally forming the image, or before starting to form a successive image, the developing roller is idly rotated. To idly rotate the developing roller is, for example, to rotate the developing roller without causing the toner to adhere onto the image carrier. Therefore, although there is a possibility of bringing about nonuniformity in the thickness, the charge amount or the like of the toner on the outer peripheral face of the developing roller since the image is developed by the toner near to a final rotation of the developing roller, by rotating the developing roller without causing the toner to adhere onto the image carrier, the uniform toner can be adhered onto the outer peripheral face of the developing roller to enable to bring about a state in which the image can be developed by the toner with high quality.

The image forming apparatus according to the invention may have the following structure in addition to the device described above. More specifically, the trailing end portion of the medium is substantially as long as a circumference of the roller.

According to an aspect of the invention, when the image forming operation is stopped developing the image by the toner after the final rotation of the developing roller, the developing roller is idly rotated after finishing to form the image, or before starting to form a successive image. Therefore, the image is developed by the toner by finally rotating the developing roller without idly rotating the developing roller indiscreetly, when there is brought about the nonuniformity in the thickness, the charge amount or the like of the toner on the outer peripheral face influencing on the quality in the successive image developed by the toner, there can be brought about a state of adhering the uniform toner by idly rotating the developing roller to enable to bring about the state in which the image can be developed by the toner with high quality.

The image forming apparatus according to the invention may have the following structure in addition to the device described above. More specifically, when toner density of the first image is greater than a predetermined value, the controller causes the roller to rotate without causing the toner to adhere onto the image carrier in association with the information.

According to an aspect of the invention, when the image is finally formed by fixing a large amount of the toner to the trailing end side of the medium, the developing roller is idly rotated after finishing to form the image, or before starting to form the successive image. Therefore, the image is developed by adhering the large amount of the toner to the image carrier about the final rotation of the developing roller, when there is brought about the nonuniformity in the thickness, the charge amount or the like of the toner on the outer peripheral face influencing on the quality in developing the successive image by the toner, there can be brought about the state of adhering the uniform toner by idly rotating the developing roller to enable to bring about the state in which the image is developed by the toner with high quality.

The image forming apparatus according to the invention may have the following structure in addition to the device described above. More specifically, the controller comprises an acquirer acquiring information related to deterioration of the toner, and the controller causes the roller to rotate without causing the toner to adhere onto the image carrier in association with the information.

According to an aspect of the invention, when temperature or humidity of a surrounding environment, a revolution number of the developing roller or the like exceeds a threshold level of deteriorating the charge characteristic of the toner as in exceeding a previously set value and the image is formed finally on the trailing end side of the medium, the developing roller is idly rotated after finishing to form the image, or before starting to form the successive image. Therefore, the image is developed by the toner about the final rotation of the developing roller without idly rotating the developing roller indiscreetly, when there is brought about the nonuniformity in the thickness, the charge amount or the like of the toner on the outer peripheral face influencing on the quality of developing the successive image by the toner since the toner is inferior in the charge quality, there can be brought about the state of uniformly adhering the toner by idly rotating the developing roller to enable to bring about the state in which the image can be developed by the toner with high quality.

The image forming apparatus according to the invention may have the following structure in addition to the device described above. More specifically, the controller causes the roller to rotate at least one time without causing the toner to adhere onto the image carrier.

According to an aspect of the invention, the developing roller can idly be rotated by the set number of times after finishing to form the image, or before starting to form the successive image. Therefore, even when the nonuniformity is brought about in the thickness of the toner or the charge amount on the outer peripheral face of the developing roller, the developing roller is idly rotated by the number of times capable of resolving the nonuniformity or more, and there can be brought about the state in which the image can be developed by the toner with high quality by uniformly adhering the toner onto the outer peripheral face of the developing roller.

The image forming apparatus according to the invention may have the following structure in addition to the device described above. More specifically, the controller comprises an acquirer acquiring information related to color of the toner, and the controller causes the roller to rotate without causing the toner to adhere onto the image carrier in association with the information.

According to an aspect of the invention, only the developing roller of the developer containing a specific toner can idly be rotated after finally fixing to form the image, or before starting to form the successive image. Therefore, only the developing roller of the developer containing the toner having the color by which the nonuniformity of the thickness of the toner, the charge amount or the like on the outer peripheral face of the developing roller influencing on the quality of the successive image developed by the toner is idly rotated to enable to bring about the state in which the image is developed by the toner with high quality by uniformly adhering the toner onto the outer peripheral face of the developing roller.

In this way, according to an aspect of the invention, when there is brought about the nonuniformity influencing on the quality of the successive image developed by the toner in the toner on the outer peripheral face of the developing roller at standby, the developing roller is idly rotated and therefore, the toner can uniformly be adhered onto the outer peripheral face of the developing roller. Therefore, even when the standby time period is short, the electrostatic latent image on the surface of the image carrier can be developed with the toner with high quality from beginning to start to form the successive image and the high quality image can be formed highly reliably.

According to the present invention, there is provided:

an image forming apparatus forming an image corresponding to image data on a medium being transported, the image forming apparatus comprising:

an image carrier on which an electrostatic latent image associated with the image data is formed;

a plurality of developers associated with a plurality of colors, each of which comprising:

a container containing toner having one of the colors;

a roller facing the image carrier and causing the toner to adhere onto the image carrier to develop the electrostatic image with the toner as the image; and an applier applying the toner to the roller;

a development unit configured to be rotatable around an rotational axis thereof, the development unit detachably housing a plurality of the developer around the rotational axis; and a controller operable to receive the image data and to control the roller in correspondence to the image data, wherein the image data includes first image data corresponding to a first image and second image data corresponding to a second image, the controller receives the second image data after the formation of the first image, and after the formation of the first image and before the formation of the second image, the controller causes the roller to rotate without causing the toner to adhere onto the image carrier when the first image includes a prescribed one of the colors.

According to an aspect of the invention, when the image is formed by a toner having a specific color, after finishing to form the image before shifting to a standby state, or before starting to form the successive image after standby, the developing roller of the developer containing the toner having the specific color is idly rotated. Therefore, only the developing roller of the developer containing the toner having the color by which the nonuniformity in the thickness, the charge amount or the like of the toner on the outer peripheral face of the developing roller is idly rotated without idly rotating the developing roller indiscreetly, and the toner is uniformly adhered onto the outer peripheral face of the developing roller to enable to bring about a state in which the image can be developed by the toner with high quality.

The image forming apparatus according to the invention may have the following structure in addition to the device described above. More specifically, the image forming apparatus is operable to form the image in a monochrome mode and a color mode, and the color is used in the monochrome mode.

According to an aspect of the invention, after finishing to form the image or before starting to form the successive image, only the developing roller of the developer containing the specific toner for continuously printing the monochrome image can idly be rotated. Therefore, other developing roller is not idly rotated indiscreetly, when the developing roller used for forming the previous image and the developing roller used for forming the successive image stay the same and the nonuniformity in the thickness, the charge amount or the like of the toner on the outer peripheral face of the developing roller produced in forming the previous image influences on the quality of the successive image developed by the toner, only the developing roller is idly rotated, and the toner is adhered uniformly onto the outer peripheral face of the developing roller to enable to bring about a state in which the image is developed by the toner with high quality. Particularly, the toner of black (K) for forming the monochrome single color image having a large frequency of being printed continuously is more liable to produce the nonuniformity in the toner on the outer peripheral face of the developing roller than other colors and therefore, it is preferable to set black (K) for the toner.

The image forming apparatus according to the invention may have the following structure in addition to the device described above. More specifically, the first image is formed onto a trailing end portion of the medium.

According to an aspect of the invention, when the image is formed on the trailing end side of the medium in finally developing the image by the toner having the set color before shifting to the standby state, after finishing to form the image, or before starting to form the successive image, the developing roller is idly rotated. Therefore, although there is a possibility of producing the nonuniformity in the thickness, the charge amount or the like of the toner on the outer peripheral face of the developing roller since the image is developed by the toner about the final rotation of the developing roller, by idly rotating the developing roller, the toner can be adhered uniformly onto the outer peripheral face of the developing roller to enable to bring about a state in which the image is developed by the toner with high quality.

The image forming apparatus according to the invention may have the following structure in addition to the device described above. More specifically, the trailing end portion of the medium is substantially as long as a circumference of the roller.

According to an aspect of the invention, when in developing the image by the toner by the final rotation of the developing roller for developing the electrostatic latent image with the toner having the set color, operation of forming the image is stopped, after finishing to form the image, or before starting to form the successive image, the developing roller is idly rotated. Therefore, the developing roller is not idly rotated indiscreetly, when the image is developed by the toner by the final rotation of the developing roller and there is produced the nonuniformity in the thickness, the charge amount or the like of the toner on the outer peripheral face influencing on quality of the successive image developed by the toner, there can be brought about a state of uniformly adhering the toner by idly rotating the developing roller to enable to bring about a state in which the image is developed by the toner with high quality.

The image forming apparatus according to the invention may have the following structure in addition to the device described above. More specifically, when toner density of the first image is greater than a predetermined value, the controller causes the roller to rotate without causing the toner to adhere onto the image carrier in association with the information.

According to an aspect of the invention, when a large amount of the toner is fixed to the medium in finally forming the image by the toner having the set color, after finishing to form the image, or before starting to form the successive image, the developing roller is idly rotated. Therefore, the developing roller is not idly rotated indiscreetly, when there is brought about the nonuniformity in the thickness, the charge amount or the like of the toner on the outer peripheral face of the developing roller influencing on quality of the successive image developed by the toner, there can be brought about a state in which the toner is adhered uniformly by idly rotating the developing roller to enable to bring about a state in which the image can be developed by the toner with high quality.

The image forming apparatus according to the invention may have the following structure in addition to the device described above. More specifically, the controller comprises an acquirer acquiring information related to deterioration of the toner, and the controller causes the roller to rotate without causing the toner to adhere onto the image carrier in association with the information.

According to an aspect of the invention, when a threshold level of deteriorating the characteristic of charging the toner is exceeded such that temperature or humidity of a surrounding environment, a revolution number of the developing roller or the like exceeds a previously set value and the image is formed by the toner having the set color, after finishing to form the image, or before starting to form the successive image, the developing roller is idly rotated. Therefore, the developing roller is not idly rotated indiscreetly, when the image is developed by the toner of the set color and there is brought about a nonuniformity in the thickness, the charge amount or the like of the toner on the outer peripheral face of the developing roller influencing on quality of the successive image developed by the toner since the toner is inferior in the charging characteristic, there can be brought about a state in which the toner is uniformly adhered by idly rotating the developing roller to enable to bring about a state in which the image can be developed by the toner with high quality.

The image forming apparatus according to the invention may have the following structure in addition to the device described above. More specifically, the controller causes the roller to rotate at least one time without causing the toner to adhere onto the image carrier.

According to an aspect of the invention, after finishing to form the image or before starting to form the successive image, the developing roller can idly be rotated by the set number of times. Therefore, even when there is produced the nonuniformity in the thickness, the charge amount or the like of the toner on the outer peripheral face of the developing roller, the developing roller is idly rotated a number of times capable of resolving the nonuniformity or more, and the toner is uniformly adhered onto the outer peripheral face of the developing roller to enable to bring about a state in which the image can be developed by the toner with high quality.

In this way, according to an aspect of the invention, when the electrostatic latent image is developed by the toner having the set color and there is brought about the nonuniformity in the toner on the outer peripheral face of the developing roller at standby influencing on quality of the successive image developed by the toner, after finishing to form the image or before starting to form the successive image, the developing roller is idly rotated and therefore, the toner can be adhered uniformly onto the outer peripheral face of the developing roller. Therefore, even when the standby time period is short, the electrostatic latent image on the surface of the image carrier is developed with the toner with high quality from beginning to start to form the successive image to enable to form the high quality image reliably.

According to the present invention, there is provided:

an image forming apparatus forming an image corresponding to image data on a medium being transported, the image forming apparatus comprising:

an image carrier on which an electrostatic latent image associated with the image data is formed;

a plurality of developers, each of which comprising:

a container containing toner;

a roller facing the image carrier and causing the toner to adhere onto the image carrier to develop the electrostatic image with the toner as the image;

an applier applying the toner to the roller; and a memory rewritably storing first information;

a development unit configured to be rotatable around an rotational axis thereof, the development unit detachably housing a plurality of the developer around the rotational axis; and a controller operable to receive the image data and to control the roller in correspondence to the image data and comprising a rewriter operable to rewrite the first information, wherein the controller causes first one of the plurality of developers not to face the image carrier and causes second one of the plurality of developers to face the image carrier, and the controller causes the second one of the plurality of developers to rotate without causing the toner to adhere onto the image carrier and the rewriter rewrites the first information stored in the memory of the first one of the plurality of developers.

According to an aspect of the invention, before shifting to a standby state, in parallel with operation of rewriting information stored in the memory of the developer and the developing roller of other developer is idly rotated. Therefore, even when the image is developed by the toner about the final rotation of the developing roller and there is brought about the nonuniformity in the thickness, the charge amount or the like of the toner on the outer peripheral face, by idly rotating the developing roller, the toner can uniformly be adhered onto the outer peripheral face to enable to bring about a state in which the image can be developed by the toner with high quality.

The image forming apparatus according to the invention may have the following structure in addition to the device described above. More specifically, the image data includes first image corresponding to a first image and second image data corresponding to a second image, the controller receives the second image data after the formation of the first image, the first one of the plurality of developers is associated with the first image, and the second one of the plurality of developers is associated with the second image.

According to an aspect of the invention, in forming the image after standby, the developing roller idly rotated immediately before shifting to the standby state is made to be opposed to the image carrier to form the image. Therefore, the electrostatic latent image formed based on successively received the image data can be developed with the toner with high quality by the developing roller resolving the nonuniformity in the thickness, the charge amount or the like by adhering the toner uniformly onto the outer peripheral face.

The image forming apparatus according to the invention may have the following structure in addition to the device described above. More specifically, the first one of the plurality of developers is adjacent to the second one of the plurality of developers in a rotating direction of development unit, and the first one of the plurality of developers faces the image carrier before the second one of the plurality of developers faces the image carrier.

According to an aspect of the invention, by only rotating the developing rotary unit so as to shift the developing roller opposed to the image carrier one by one, operation of rewriting information stored in the memory before standby and idle rotation of the developing roller can be executed and when the idly rotated developing roller is used in forming the successive image, the contained toner can be consumed by shifting the developers used one by one. Therefore, by idly rotating the developing roller used after standby, the image is developed by the toner with high quality by uniformly adhering the toner onto the outer peripheral face and the toner contained in the plurality of developers can uniformly be consumed.

The image forming apparatus according to the invention may have the following structure in addition to the device described above. More specifically, the controller comprises an acquirer acquiring second information related to deterioration of the toner, and the controller causes the roller to rotate without causing the toner to adhere onto the image carrier in association with the second information.

According to an aspect of the invention, when a threshold level of deteriorating the characteristic of charging the toner is exceeded such that temperature or humidity of a surrounding environment, a revolution number of the developing roller or the like exceeds a previously set value, before starting to form the successive image, the developing roller is idly rotated. Therefore, the developing roller is not idly rotated indiscreetly, even when there is brought about the nonuniformity in the thickness, the charge amount or the like of the toner on the outer peripheral face of the developing roller influencing on quality of the successive image developed by the toner since the characteristic of charging the toner is inferior, there can be brought about a state of uniformly adhering the toner by idly rotating the developing roller to enable to bring about a state in which the image can be developed by the toner with high quality.

The image forming apparatus according to the invention may have the following structure in addition to the device described above. More specifically, the controller causes the roller to rotate at least one time without causing the toner to adhere onto the image carrier.

According to an aspect of the invention, before starting to form the successive image, the developing roller can idly be rotated by the set number of times. Therefore, even when there is brought about the nonuniformity in the thickness, the charge amount or the like of the toner on the outer peripheral face of the developing roller, the developing roller can idly be rotated by a number of times capable of resolving the nonuniformity or more and the toner is uniformly adhered onto the outer peripheral face of the developing roller to enable to bring about a state in which the image can be developed by the toner with high quality.

In this way, according to the invention, when there is a possibility of bringing about the nonuniformity in the toner of the outer peripheral face of the developing roller at standby influencing on quality of the successive image developed by the toner, the developing roller is idly rotated and therefore, the toner can uniformly be adhered onto the outer peripheral face of the developing roller. Therefore, even when a standby time period is short, the electrostatic latent image on the surface of the image carrier can be developed with the toner with high quality from beginning to start to form the successive image to enable to form the image with high quality reliably.

DETAIL DESCRIPTION OF PREFERRED EMBODIMENTS

The first embodiment of the invention will be explained in reference to the drawings as follows. FIG. 1 through FIG. 4 are views showing an embodiment of an image forming apparatus according to the invention.

Figure 1:
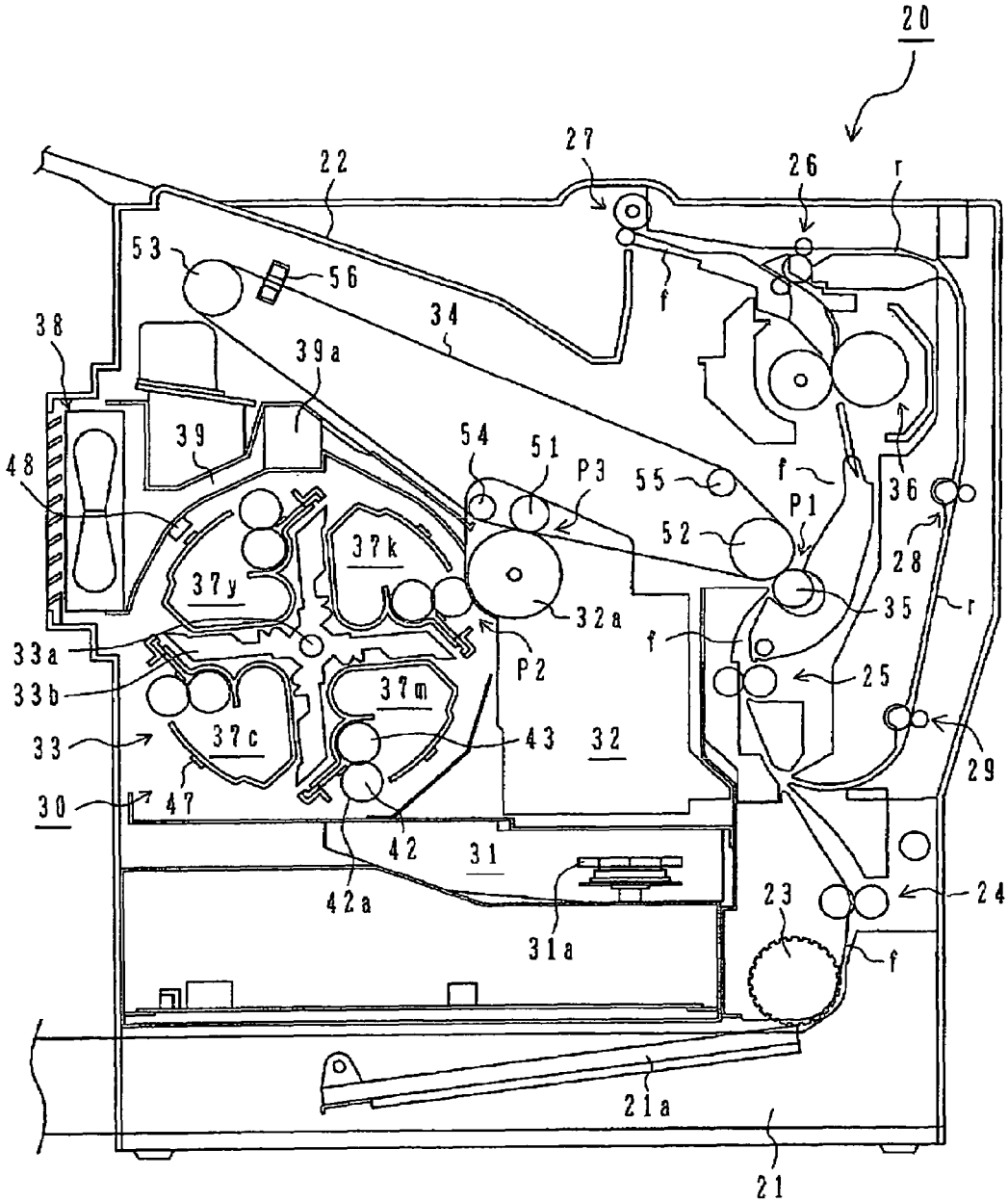
FIG. 1 is a view showing an embodiment of an image forming apparatus according to the invention and is a perspective front view showing a substantial entirely constitution thereof.
Figure 2:
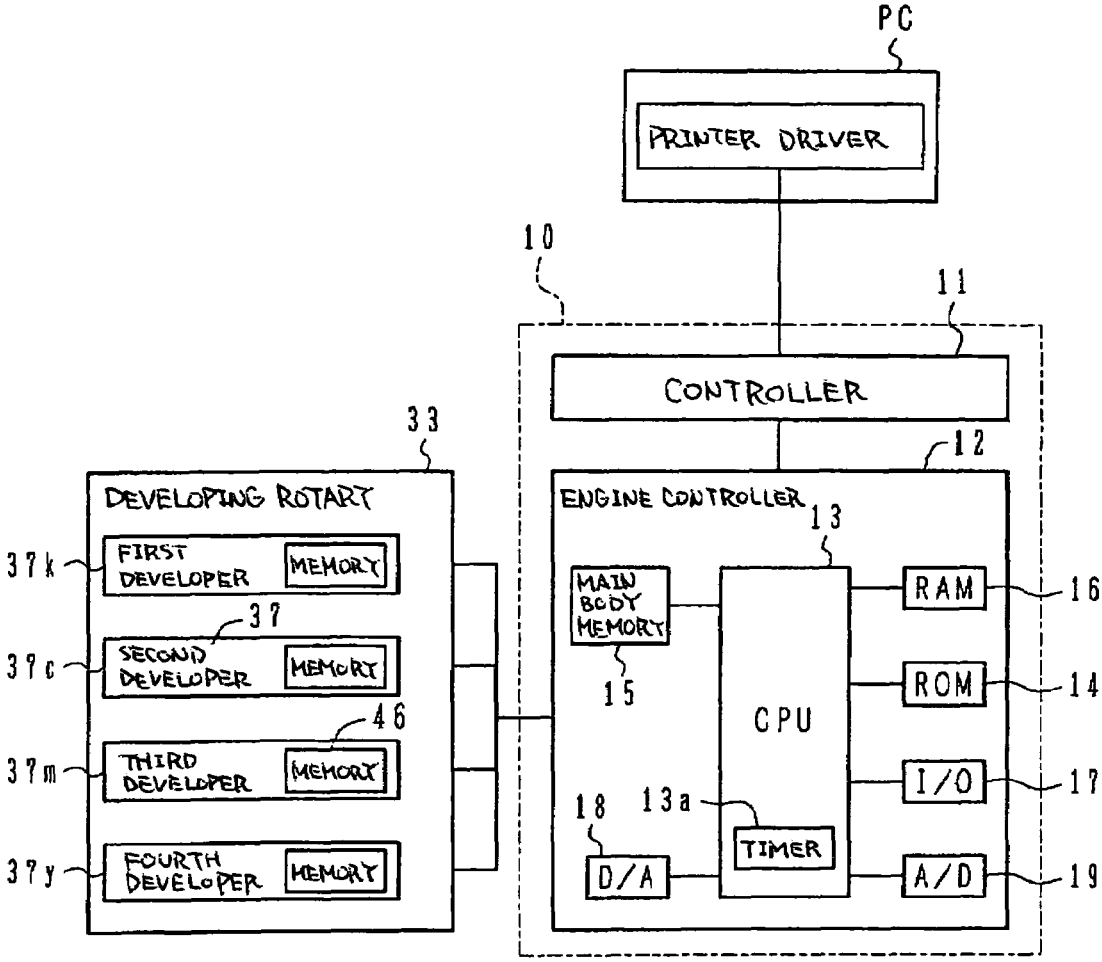
FIG. 2 is a related block diagram for explaining a controller thereof.

In FIG. 1 and FIG. 2, an image forming apparatus is utilized by being connected to, for example, a personal computer PC for forming and outputting an image of a character or the like. A control unit 10 connected to the personal computer PC controls a sheet transporting apparatus 20 and an image recording apparatus 30 so that an image is formed on record sheet (record medium) to be printed out.

The control unit 10 is constituted by a controller 11 and an engine controller 12 constructed on a circuit board mounted to inside of an apparatus main body, which execute processing control of various data and driving control of respective parts of the apparatus in accordance with previously prepared programs.

CPU, not illustrated executes various processing procedures in accordance with processing programs stored in a memory, not illustrated, so that the controller 11 communicates various information of printing instruction or the like between the controller 11 and a printer driver of the personal computer PC and receives image data of a text or the like for forming an image to be printed on the record sheet and temporarily stores in the memory. Since the image data (image information signal) received from the personal computer PC is so-called RGB data of red (R), green (G), blue (B), the controller 11 reads the RGB data from the memory while converting the RGB data into image data of printable so-called YMCK data of yellow (Y), magenta (M), cyan (C), black (K) to deriver to the engine controller 12.

The engine controller 12 receives image data by, for example, a unit of page to be temporarily stored in a main body memory 15 from the controller 11 in accordance with a control program stored in ROM 14 by CPU 13, and forms the image based on the image data on the record sheet by communicating various information between the engine controller 12 and the sheet transporting apparatus 20 and the image recording apparatus 30 while using RAM 16 as a work area. At the above operation, CPU 13 optimally operates various parts of the apparatus by counting various processing time by an included timer function (counting means) 13*a* in executing the image forming control.

In FIG. 2, an I/O interface 17 is connected to the controller 11, the sheet transporting apparatus 20 and the image recording apparatus 30 and the engine controller 12 to be able to communicate various information. A D/A converter 18 and an A/D converter 19 convert a digital signal (D) into an analog signal (A) or convert the analog signal into the digital signal such that various information communicated between the engine controller 12 and the controller 11, the sheet transporting apparatus 20 and the image recording apparatus 30 can respectively be processed.

The sheet transporting apparatus 20 is constructed by an intermediate transferring belt 34, a transferring roller 35, a fixing roller pair 36 which are also constituent elements of the image recording apparatus 30 in addition to a sheet cassette 21, a sheet discharge table 22, a pickup roller 23, a transporting roller pair 24, a registration roller pair 25, a switch roller pair 26, a sheet discharge roller pair 27, and reverse roller pairs 28, 29. The sheet transporting apparatus 20 separates and transports a plurality of sheets of the record sheet laminated in the sheet cassette 21 sheet by sheet to feed to a position P1 for forming to record an image by the image recording apparatus 30 to thereby form to record image data of a character or the like received on one face side or both faces sides of the record sheet and thereafter transports the record sheet finished to form the image to outside of the apparatus to laminate on the sheet discharge table 22.

The pickup roller 23 is brought into press contact with the record sheet laminated on an elevating plate 21*a* in the sheet cassette 21 to rotate to thereby draw the record sheet and separates the record sheet sheet by sheet to feed to a transport path f in cooperation with a separating unit, not illustrated. The transporting roller pair 24 nips to transport the record sheet and corrects skew thereof by abutting a front end thereof to a nip portion of the registration roller pair 25 on a downstream side. The registration roller pair 25 nips the record sheet to feed to the position P1 of forming to record the image in synchronism with operation of the image recording apparatus 30.

At the position P1 of forming to record the image, the intermediate transferring belt 34 and the transferring roller 35 transport the record sheet by being rotated while nipping the record sheet so as to form to record the image by secondarily transferring the toner image formed in the image recording apparatus 30, mentioned later, and primarily transferred on the intermediate transferring belt 34 on one face side of the record sheet. Further, the fixing roller pair 36 transports the record sheet to further downstream side by being rotated while nipping the record sheet and fuses the image on the record sheet.

Thereafter, the switch roller pair 26 and the sheet discharge roller pair 27 transport the record sheet from the fixing roller pair 36 to laminate on the sheet discharge table 22. Thereby, the record sheet is fed to the position P1 for forming to record the image by the image recording apparatus 30 to form the image on one face thereof by constituting the one face side as a face of forming to record the image and thereafter discharged onto the sheet discharge table 22.

At the above operation, a double faces mode of forming the images on double faces of the record sheet is instructed by the engine controller 12, the sheet transporting apparatus 20 transports the record sheet formed to record the image on the one face side to a reverse path r by temporarily stopping the sheet discharge roller pair 27 at a position of nipping a trailing end portion of the record sheet transported onto the sheet discharge table 22 and thereafter reversely driving to rotate along with the switch roller pair 26.

Thereafter, the reverse roller pairs 28, 29 nip the record sheet to transport in the reverse path r so that the reverse roller pair 28, 29 transport the record sheet both sides of which are reversed, to the registration roller pair 25 by feeding the record sheet again to the transport path f, constituting a leading end side reversely by the trailing end side in forming the image to the one face side. Thereby, the record sheet is fed again to the position P1 for forming to record the image by the image recording apparatus 30 to form the images on the other face on which no image is formed to record, so that the record sheet is formed the image on double faces thereof. Thereafter the record sheet is discharged onto the sheet discharge table 22.

On the other hand, the image recording apparatus 30 is provided with an exposing unit 31, a photosensitive cartridge 32, a developing rotary unit 33, the intermediate transferring belt 34, the transferring roller 35 and the fixing roller pair 36. The image recording apparatus 30 forms to record the received image data of a character or the like on the one face side or the double faces sides of the record sheet transferred by the sheet transporting apparatus 20 to the position P1 for forming to record the image by the electronic photography system.

The exposing unit 31 forms image of the electrostatic latent image based on the image data on a surface of a photosensitive drum 32*a* by selectively irradiating laser light to the surface of the photosensitive drum (image carrier) 32*a* in the photosensitive cartridge 32 to expose and scan based on the image data received by a laser light scanning apparatus (polygonal mirror) 31*a* mounted therein. The developing rotary unit 33 is provided with the developing cartridges (developer) 37 (illustrated as 37*y*, 37*c*, 37*m*, 37*k* in the drawing) for respective colors for developing the electrostatic latent images on the photosensitive drum 32*a* by toners of yellow (Y), cyan (C), magenta (M), black (K) attachably and detachably, the developing cartridge 37 in accordance with the image data for forming the electrostatic latent image is disposed at a developing position P2 opposed to the photosensitive drum 32*a* and the electrostatic latent image is developed by adhering the toner contained therein onto the photosensitive drum 32*a*.

At a transferring position P3 opposed to the photosensitive drum 32*a*, in the case of, for example, a monochrome image, the intermediate transferring belt 34 receives a toner image of black (K) which is formed on the photosensitive drum 32*a* by primarily transferring the toner image and holds a toner image to be transferred onto the record sheet on a surface of the belt. Further, in a case of a color image, the intermediate transferring belt 34 receives toner images of yellow (Y), cyan (C), magenta (M) formed on the photosensitive drum 32*a* to laminate on the surface of belt successively (the order is not limited thereto) and forms to hold the toner images of color to be transferred onto the record sheet at the transferring position P3. The transferring roller 35 secondarily transfers the toner images on the record sheet by bringing the record sheet fed to between the transferring roller 35 and the intermediate transferring belt 34 (the position P1 for forming to record the image) into press contact therewith to nip to transport. Further, the toner is transferred onto the record sheet from the developing cartridge 37 via the photosensitive drum 32*a* and the intermediate transferring belt 34 in accordance with a bias voltage between the members.

The fixing roller pair 36 fuses the toner images developed and transferred at the developing position P2 and the transferring position P3 by being brought into press contact with the record sheet transported from the position P1 for forming to record the image to heat the record sheet and nips to transport the record sheet to further downstream side. Thereby, the record sheet is recorded to form (fix) with the monochrome image or the color image based on the received image data on the one face side or the double faces sides and by repeating the operation, the image can be formed to record continuously on the plurality of the sheets.

Further, the toners remaining after having been transferred onto the intermediate transferring belt 34 are removed of electricity and recovered by a cleaning unit, not illustrated, thereafter, the photosensitive drum 32*a* is charged by a charger to an electric potential for receiving and adhering the toners from the developing cartridges 37 of the developing rotary unit 33. Further, also the intermediate transferring belt 34 is similarly removed of electricity and charged to repeat to transfer (adhere) and recover the toners. Further, the toner scattered in recovering the toner is caught by a filter 39*a* attached to an exhaust duct 39 by sucking the toner to a side of the apparatus main body by a sucking fan 38 via the exhaust duct 39.

Further, the developing rotary unit 33 is constituted by mounting a plurality of the developing cartridges 37 for developing the electrostatic latent images on the surface of the photosensitive drum 32*a* with the toners in a containing position partitioned by a partition frame 33*b* rotated about a rotating shaft 33*a*. The developing rotary unit 33 develops the toner images for forming the images by transferring the toner images on the one face or the double faces of the record sheet by switching the developing cartridge 37 at the developing positron P2 opposed to the photosensitive drum 32*a* by being rotated about the rotating shaft 33*a* in accordance with printing instruction including the image data from the personal computer PC received by CPU 13 of the engine controller 12 via the controller 11.

For example, the image forming apparatus can be utilized as an apparatus capable of forming a color image and a monochrome image by mounting the developing cartridges 37 for containing respective color toners of yellow (Y), cyan (C), magenta (M), black (K) in the developing rotary unit 33 and switching the developing cartridges 37 for developing the electrostatic latent images on the photosensitive drum 32*a* by rotating the developing rotary unit 33 to overlap or select the contained toners having respective colors.

Further, the image forming apparatus is constituted to be able to form the image even when the toner having the same color is contained in all of the developing cartridges 37 to mount in the developing rotary unit 33, for example, 4 pieces of the developing cartridges 37 containing the toner having the same color of back (K) can be mounted. In this case, the image forming apparatus can be utilized as an exclusive machine for continuously printing to form the monochrome image by successively switching the developing cartridges 37 for developing the electrostatic latent images on the photosensitive drum 32*a* by rotating the developing rotary unit 33, for example, a pleasant image forming operation can be executed by pertinently switching the developing cartridges 37 in accordance with received image data.

Figure 3:
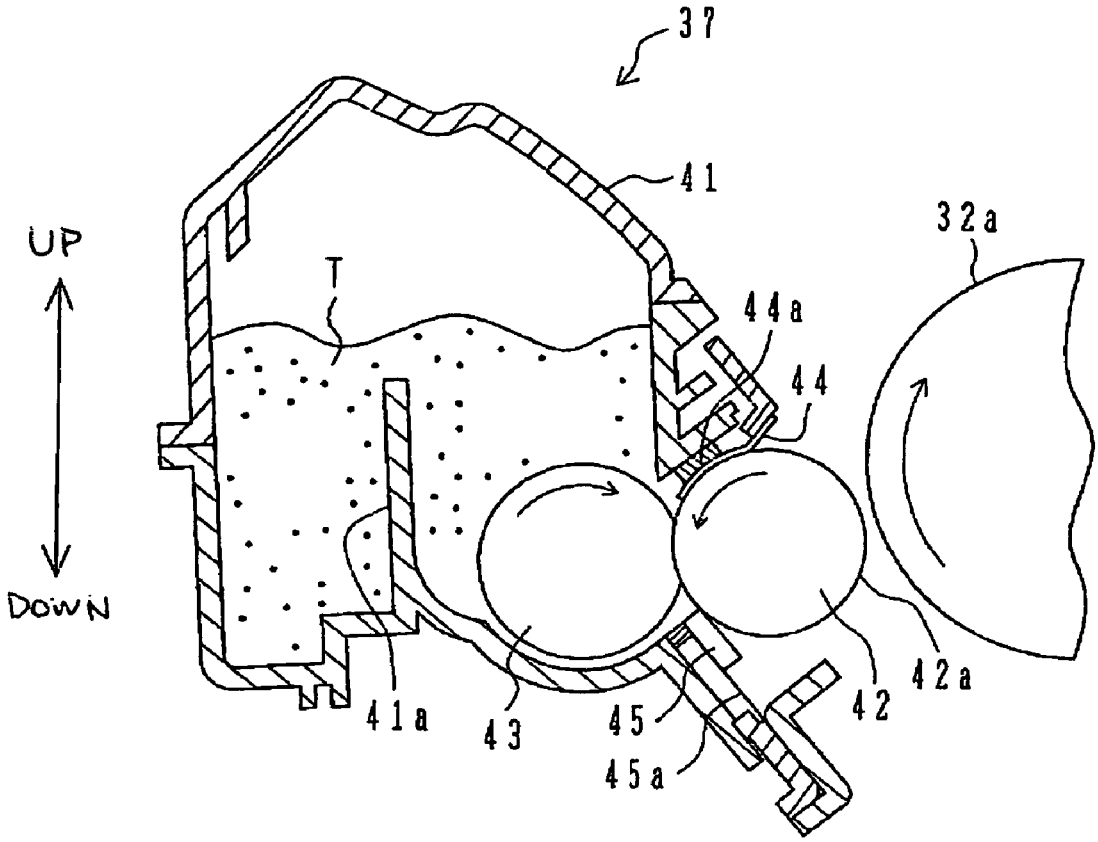
FIG. 3 is a vertical sectional view showing a constitution of a major part thereof.

As shown in FIG. 3, the developing cartridge 37 is provided with a container 41, a developing roller 42 and a supply roller 43. The containers 41 are formed by a similar shape having in respective containing spaces partitioned by the partition frame 33*b* of the developing rotary unit 33 and contain the toner T The developing roller 42 is rotatably supported by an outer peripheral side of the container 41 remote from the rotating shaft 33*a* of the developing rotary unit 33, and adheres the toner T supplied from the supply roller 43 to the photosensitive drum 32*a* opposed thereto. The supply roller 43 is rotatably supported by the container 41 contiguously to the developing roller 42 on a side of the rotating shaft 33*a* of the developing rotary unit 33, and supplies the toner T at a surrounding thereof by being brought into press contact with the developing roller 42 to rotate. The container 41 of the developing cartridge 37 is installed with a partition plate 41*a* at a position contiguous to the supply roller 43, and the partition plate 41*a* partitions a space containing the toner T in the container 41 in a state of communicating upper portions of a space on the side of the rotating shaft 33*a* and a space of installing the supply roller 43. That is, the supply roller 43 constitutes a supplier for supplying the toner T to an outer peripheral face 42*a* of the developing roller 42. The supplier is not limited to such a roller type but may naturally be a supplying unit for supplying the toner T by other type.

By the constitution, the developing cartridge 37 supplies the toner T in the space on the outer peripheral side of the container 41 partitioned by the partition plate 41*a* to the developing roller 42 brought into press contact with the supply roller 43 to rotate. Further, according to the developing cartridge 37, when the developing rotary unit 33 is rotated by 180 degrees by being rotated 90 degrees by 90 degrees in the counterclockwise direction of FIG. 1, the toner T contained on the side of the rotating shaft 33*a* of the container 41 and the toner T contained on the side of the supply roller 43 are joined together at the upper portion of the partition plate 41*a* (lower side in FIG. 1) and thereafter, by further rotating the developing rotary unit 33 90 degrees by 90 degrees, the toner T contained in the container 41 is agitated and refreshed and the contained toner T is collected to the side of the supply roller 43 to be able to supply to the developing roller 42. That is, according to the developing cartridge 37 mounted to the developing rotary unit 33 rotated in this way, the contained toner T is replenished and supplied to the side of the supply roller 43 while being agitated by the rotation and therefore, an adjusting apparatus (so-called an agitator unit or an auger unit) for operating to adjust to agitate or replenish the contained toner T can pertinently be omitted. However, when the adjusting unit is omitted, before the toner T supplied at least to the developing roller 42 is not present around the supply roller 43, an amount of using the toner T detected by, for example, a count value of a toner counter, a dot number of the image, a summed-up time period of developing operation (image forming), a summed-up number of developed sheets, or a measured remaining amount of the toner T exceeds a previously set value, it is necessary to operate to replenish and agitate the toner T by rotating the developing rotary unit 33.

Further, according to the developing cartridge 37, the developing roller 42 is exposed from inside of the container 41 to be made to be opposed to the photosensitive drum 32*a* at the developing position P2, and a gap partitioned between the outer peripheral face 42*a* of the developing roller 42 and an opening portion of the container 41 is arranged with a seal member 44 brought into press contact with the outer peripheral face 42*a* by being urged by an urging member 44*a*, and a restricting blade 45 brought into press contact with the outer peripheral face 42*a* by being urged by an urging member 44*a*. The seal member 44 prevents the toner T from being leaked to outside of the container 41 and recovers the toner T on the outer peripheral face 42*a* of the developing roller 42 passing the developing position in the container 41 without scraping off the toner T. Further, the restricting blade 45 restricts a thickness of the toner T adhered to the outer peripheral face 42*a* to be constant while scraping off the toner T at a front end side edge thereof by adjusting to bring a plane portion on a rear end side thereof into press contact with a surface of the outer peripheral face 42*a* rather than the edge on the front end side thereof. Here, the toner T on the outer peripheral face 42*a* of the developing roller 42 is charged by applying a charge voltage previously set to the restricting blade 45 and also when the supply roller 43 is brought into press contact with the developing roller 42 to rotate, the toner T is more or less charged by friction.

Further, the intermediate transferring belt 34 is formed in a shape of an endless belt hung around a primarily transferring pulley 51, a secondarily transferring pulley 52, a driven pulley 53, and tension pulleys 54, 55. The primarily transferring pulley 51 is arranged at the transferring position P3 at which the developed toner image on the photosensitive drum 32*a* is primarily transferred to the intermediate transferring belt 34 and is opposed to the photosensitive drum 32*a* on a back side of the intermediate transferring belt 34. The secondarily transferring pulley 52 is arranged at the record forming position P1 at which the primarily transferred toner image on the intermediate transferring belt 34 is secondarily transferred onto the record sheet between the transferring roller 35 and the secondarily transferring pulley 52 to form to record the image, and is opposed to the transferring roller 35 on the back side of the intermediate transferring belt 34. The driven pulley 53 is arranged on a side opposed to the secondarily transferring pulley 52 and is driven to rotate by rotating the intermediate transferring belt 34. The tension pulleys 54, 55 are arranged on both sides of the intermediate transferring belt 34 between the secondarily transferring pulley 52 and the driven pulley 53 and apply a tension from the back side of the intermediate transferring belt such that the intermediate transferring belt 34 is not positionally shifted.

The intermediate transferring belt 34 is arranged with, for example, a projected piece (so-called shim), not illustrated, projected to an outer side in a plane direction on one side, and by detecting the presence of the projected piece for each rotation by a sensor 56, CPU 13 of the engine controller 12 controls to drive to rotate the intermediate transferring belt 34 to synchronize with rotation of the photosensitive drum 32*a* or transporting operation of the record sheet. Thereby, the intermediate transferring belt 34 is opposed to the record sheet transferred to the position P1 for forming to record the image opposed to the transferring roller 35 and is driven to rotate to repeatedly circulate a path between the position P1 and the transferring position P3 opposed to the photosensitive drum 32*a*, receives the toner images of the respective color toners formed on the photosensitive drum 32*a* at the transferring position P3 and transfers the toner images onto the record sheet at the position P1 for forming to record the image.

In this way, in correspondence with rotating the intermediate transferring belt 34, particularly when the color image is formed, the developing rotary unit 33 needs to successively switch the developing cartridges 37 for developing the toner images. Therefore, whereas the intermediate transferring belt 34 is set to be longer than a size of the record sheet for forming the color image to hold toner images transferred onto the record sheet, the developing rotary unit 33 needs to finish the operation of switching the developing cartridges 37 during a time period of rotating to move an interval between a trailing end of the toner image and a leading end of the successive toner image on the intermediate transferring belt 34 (interval between the trailing end of the record medium and the leading end of the successive record sheet, so-called sheet interval).

Further, an involatile memory 46 and a developing side connector 47 are individually included in the developing cartridge 37, and a control side connector 48 is arranged on a side of a main body of the developing rotary unit 33. The involatile memory 46 is rewritably stored with various information of a color of a toner contained, date of manufacture, a consumed amount or the like in addition to a number of times of mounting and a number of times of recycling the developing cartridge 37 per se along with identification information of a manufacturing number or the like, and the developing side connector 47 is connected respectively to the involatile memories 46 and reads or rewrites the information stored with the involatile memories 46. The control side connector 48 is installed not to move to an inner wall face of the developing rotary unit 33 to be opposed to the developing side connector 47 of the developing cartridge 37 rotated in the counterclockwise direction by 90 degrees from the developing position P2 at which the developing roller 42 is opposed to the photosensitive drum 32*a*, and communicates various information by noncontact communication by being opposed to the developing side connector 47 of the developing cartridge 37 after the developing operation. Thereby, the engine controller 12 of the control unit 10 executes an image forming control including a control of switching the developing cartridges 37 optimally by pertinently grasping various information of color information of the toner of the developing cartridge 37 along with presence/absence, a position or the like of the developing cartridge 37 contained at a containing position of the developing rotary unit 33.

CPU 13 of the engine controller 12 executes various kinds of control operation in accordance with control programs in ROM 14 after making a power source ON, and when the power source is made ON or when the developing cartridge 37 is interchanged, by executing noncontact communication via the connectors 47, 48, presence/absence of the developing cartridge 37 at the position of the developing rotary unit 33 for containing the developing cartridge 37, or a number of times of mounting the developing cartridge 37, a number of times of recycling the developing cartridge 37 is held (stored) in the main body memory 15. Further, the CPU 13 successively reads various kinds of information written in the involatile memory 46 of each developing cartridge 37 via the connectors 47, 48 and holds position information, the information of the toner, a consumed amount (remaining amount) or the like in the main body memory 15. Further, during the operation of forming the image or after forming the image, the CPU 13 writes various kinds of information of an amount of the toner consumed by forming the image and the like into the involatile memory 46 of each developing cartridge 37 via the connectors 47, 48 to rewrite.

In other words, each time of receiving the instruction of printing the image data, CPU 13 pertinently switches the developing cartridge 37, having each color toner, mounted to the developing rotary unit 33 in accordance with a kind of an image based on the image data, a position of forming the image on the record sheet and the like, drives to rotate the developing roller 42, the supply roller 43 and the like by a previously set drive timing, thereby, forms a uniform toner image on the photosensitive drum 32*a* to form the high quality image on the record sheet via the intermediate transferring belt 34 while rewriting various kinds of information stored in the involatile memory 46.

Specifically, when the instruction of printing the image data for forming to record the color image on the record sheet is received from the controller 11, CPU 13 confirms whether the image data is image data for forming the image having a density equal to or greater than a previously set density at the trailing end portion of the record sheet of the final page by using the toner of black (K) and operates to switch a timing of driving the developing cartridge 37*k* containing the toner of black (K). In sum, in the case of image data in which an image is not present at the trailing end portion of record sheet, or in the case of image data which hardly consumes the toner of black (K) even when an image is present, even in a general drive control in which the developing roller 42 is stopped as it is after forming the image (after developing the electrostatic latent image), the developing cartridge 37*k* is stopped in a state in which the toner is adhereed onto the outer peripheral face 42*a* of the developing roller 42 on which the electrostatic latent image on the photosensitive drum 32*a* to refresh and to replenish is developed with the toner. In contrast thereto, in the case of image data for forming an image having a density equal to or greater than the set density at the trailing end portion of the record sheet of the final page before shifting to a standby state, in a general drive control for equivalently controlling to drive to operate all of the developing cartridges 37, the developing roller 42 is stopped to drive to rotate without adhering the toner to refresh and replenish onto the outer peripheral face 42*a* of the developing roller 42 of the developing cartridge 37*k* on which the electrostatic latent image on the photosensitive drum 32*a* is developed by the toner and therefore, in such a case, CPU 13 executes a drive control for operating to refresh and replenish the toner on the outer peripheral face 42*a* of the developing roller 42.

For example, in the case in which a peripheral length of the developing roller 42 is 40 mm and after passing through a region of the photosensitive drum 32*a* in correspondence with the trailing end of the record sheet, the developing roller 42 is rotated further by an amount of 15 mm and stopped, when there is included image data of the trailing end portion of the record sheet to be developed by the outer peripheral face 42*a* of the developing roller 42 of an amount of 35 mm to which the toner of black (K) is not supplied from the supply roller 43 by rotating the developing roller 42 by the 15 mm and at the same time, a dot count duty of the image data of the trailing end portion is equal to or larger than 50% of a set value, CPU 13 selectively executes a drive control for refreshing and replenishing the toner on the outer peripheral face 42*a* of the developing roller 42. A threshold level of whether the control is to be executed is not limited to the count duty but whether the drive control is to be executed may be determined by other condition, further, also the count duty value may naturally be changed from 50%. For example, picture element data having one page data of the record sheet divided into ten data each of which has the same size between the leading end portion and the trailing end portion of the record medium is stored in the main body memory 15, CPU 13 executes the image forming operation by storing and processing the picture element data. Further, when ratio of black data corresponding to the toner of black in the last one data corresponding to the trailing end portion of the record medium of the picture element data is equal to or greater than 20%, CPU 13 executes the drive control for refreshing and replenishing the toner one time. When the ratio of the black data in the last one data of the picture element data is equal to or greater than 50%, CPU 13 executes the drive control for refreshing and replenishing the toner two times. The operation of refreshing and replenishing the toner on the outer peripheral face 42*a* of the developing roller 42 is not limited to black (K) but the operation may naturally be executed for the developing cartridge 37 containing the toner of other color.

Figure 4:
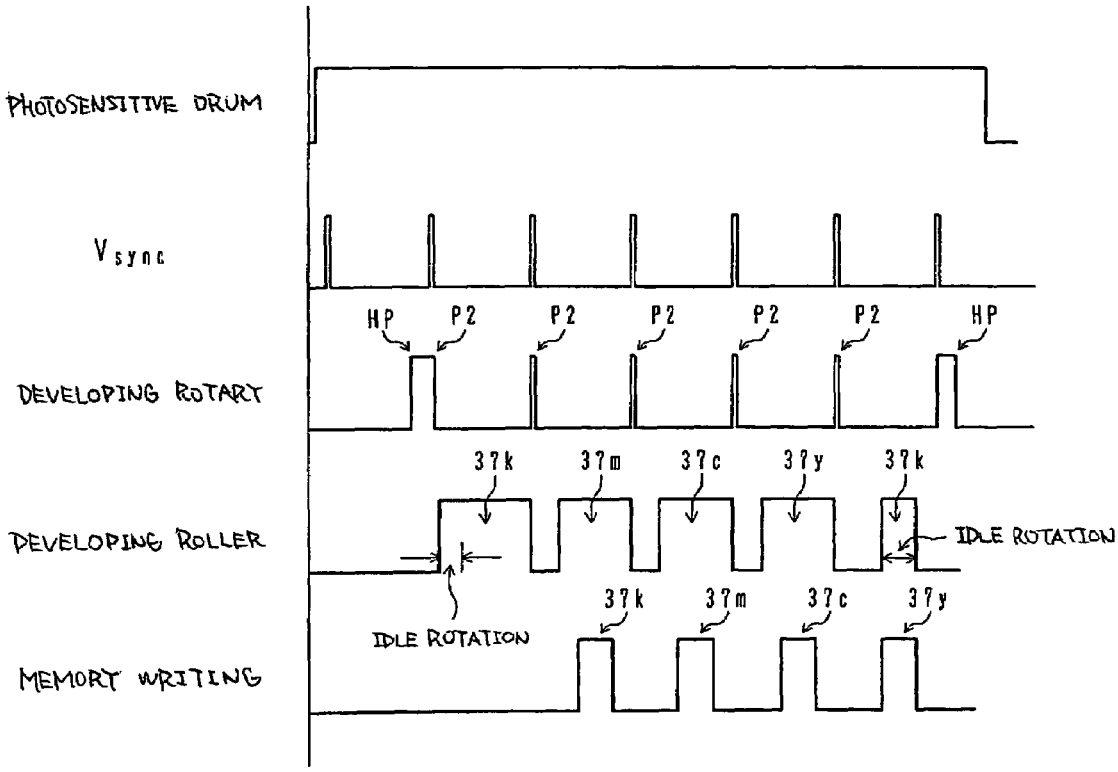
FIG. 4 is a timing chart for explaining a drive control thereof.

Further, when CPU 13 receives the image data for forming the image having the density equal to or greater than the set density by using the toner of black (K) at the trailing end portion of record sheet of the final page immediately before standby in this way, as shown in FIG. 4, successive to starting to drive the photosensitive drum 32*a* and the intermediate transferring belt 34 or the like, CPU 13 drives the developing rotary unit 33. At this operation, CPU 13 cooperatively operates pertinently to develop the electrostatic latent image on the photosensitive drum 32*a* and form the image by transferring the toner image formed by the development on the record sheet via the intermediate transferring belt 34 (primary and secondary transcription), drives the developing roller 42 to synchronize the developing operation by the developing cartridge 37*k* to a sensor signal (Vsync) from the sensor 56 for detecting the projected piece (shim) of the intermediate transferring belt 34 and idly rotates the developing roller 42 at a previously set timing. To idly rotate the developing roller is, for example, to rotate the developing roller without causing the toner to adhere onto the image carrier. That is, when the image having the density equal to or greater than the set density is formed by using the toner of black (K) at the trailing end portion of the record sheet of the final page immediately before standby, immediately after finishing the image forming operation and before starting the successive image forming operation, CPU 13 rotates the developing roller 42 of the developing cartridge 37*k* by one rotation (set number of times) or more and in view of an efficiency for charging the toner of black (K), preferably, the developing roller 42 is set to idly rotate by two rotations or more.

Therefore, the developing rollers 42 of the developing cartridges 37*y*, 37*c*, 37*m* are not idly rotated indiscreetly, and only the developing roller 42 of the developing cartridge 37*k* containing the toner of black (K) by which the nonuniformity (in thickness or charge amount) of the toner is difficult to be resolved immediately but is liable to influence on the developing quality can be rotated idly after and before the image forming operation, and can idly be rotated by a number of times necessary for bringing about the state in which the toner is adhered uniformly onto the outer peripheral face 42*a* of the developing roller 42. Further, even in the case of the image data using the toner of black (K), the developing roller 42 of the developing cartridge 37*k* can be idly rotated only in the case of the image having the density equal to or greater than the set density at the trailing end portion of the record sheet of the final page immediately before standby, while avoiding deterioration in the contained toner by unnecessary rotation (indiscreet idle rotation) of the developing roller 42, the electrostatic latent image on the photosensitive drum 32*a* can be developed with the toner with high quality by resolving the nonuniformity of the toner on the outer peripheral face 42*a* of the developing roller 42.

In details, at standby of the developing operation at which CPU 13 does not receive the image data from the controller 11, the developing roller 42 of the developing cartridge 37*k* containing the toner of black (K) is rotated in the counterclockwise direction substantially by 120 degrees from the developing position P2 opposed to the photosensitive drum 32*a* (constituting an attitude of toppling the developing cartridge 37*k*), and the developing rotary unit 33 is disposed at a home position (HP) at which the developing rollers 42 of all of the developing cartridges 37 and the like are disengaged from a drive gear train, not illustrated.

In the case in which CPU 13 receives printing instruction at the standby time, when in the image forming operation immediately before the standby, the image having the density equal to or greater than the set density is formed by using the toner of black (K) on the trailing end portion of the record sheet, first, the developing rotary unit 33 is rotated in the counterclockwise direction from the home position to the developing position P2 at which the developing cartridge 37*k* is opposed to the photosensitive drum 32*a*, and when the developing rollers 42 and the like are brought in mesh with the drive gear train, the developing roller 42 of the developing cartridge 37*k* is idly rotated by being started to drive to rotate prior to a timing of forming the electrostatic latent image on the photosensitive drum 32*a* to refresh and replenish the toner on the outer peripheral face 42*a*.

Thereby, even in standby in a short period of time, after developing the final page by the previous image forming operation, even when there is nonuniformity in the thickness or the charge amount or the like the toner on the outer peripheral face 42*a* of the developing roller 42 of the developing cartridge 37*k*, before starting the image forming operation of the received image data, the nonuniformity of the toner can be resolved to be uniform by idly rotating the developing roller 42, and the electrostatic latent image on the photosensitive drum 32*a* can be developed from starting the image forming operation. Here, as mentioned later, when the image having the density equal to or greater than the set density is formed by using the toner of black (K) on the trailing end portion of record sheet of the final page, the developing roller 42 of the developing cartridge 37*k* is idly rotated even after finishing the developing operation and therefore, the developing roller 42 may be rotated by one rotation such that the thickness, the charge amount and the like of the toner on the outer peripheral face 42*a* become uniform, however, in consideration of the efficiency of charging the toner of black (K), so far as time is permitted, it is preferable to rotate the developing roller 42 by two rotations or more.

After idly rotating the developing roller 42 of the developing cartridge 37*k*, the developing rotary unit 33 executes the general image forming operating as it is, when the developing operation of using the toner of black (K) of the developing cartridge 37*k* has been finished, the developing rotary unit 33 is rotated by 90 degrees in the counterclockwise direction, the developing roller 42 of the successive developing cartridge 37*m* for containing the toner of magenta (M) is disposed at the developing position P2 opposed to the photosensitive drum 32*a* and thereafter, similar operation is repeated. At this operation, when the developing cartridge 37*m* is disposed at the developing position P2, the developing rotary unit 33 rotates the developing cartridge 37*k*, which has executed the developing operation immediately therebefore, by 90 degrees, the developing side connector 47 of the developing cartridge 37*k* is opposed to the control side connector 48 on the main body side communicatably in noncontact and therefore, CPU 13 sums up a time period of driving the developing roller 42 and an amount of consuming the toner and rewrites information stored in the involatile memory 46.

Further, the developing rotary unit 33 is rotated by 90 degrees in the counterclockwise direction even after the developing roller 42 of the final developing cartridge 37*y* for containing the toner of yellow (Y) for forming the color image is disposed at the developing position P2 opposed to the photosensitive drum 32*a*, by rotating the developing rotary unit 33 by 90 degrees, the developing side connector 47 of the developing cartridge 37*y* and the control side connector 48 are opposed to each other, CPU 13 rewrites the information stored in the involatile memory 46 of the developing cartridge 37*y* and thereafter, the developing rotary unit 33 is rotated by 120 degrees to be disposed at the home position (HP) to shift to the standby state.

At this operation, when CPU 13 receives image data for forming to record the image having the density equal to or greater than the set density by using the toner of black (K) on the trailing end portion of the record sheet of the final page in the image forming operation, in parallel with operation of rewriting the information stored in the involatile memory 46 of the developing cartridge 37*y*, CPU 13 drives to rotate (idly rotate) the developing roller 42 of the developing cartridge 37*k* brought in mesh with the drive gear train by being disposed at the developing position P2 opposed to the photosensitive drum 32*a* so as to refresh and replenish the toner on the outer peripheral face 42*a*.

Thereby, in the case in which the image forming operation has been finished to shift to the standby state even by a short period of time, after developing the final page of the image forming operation, even when there is the nonuniformity in the thickness, the charge amount or the like of the toner on the outer peripheral face 42*a* of the developing roller 42 of the developing cartridge 37*k*, without particularly ensuring an exclusive period of time, in parallel with operation of rewriting the information stored in the involatile memory 46 (before starting the image forming operation by receiving the image data after standby), the nonuniformity of the toner can be resolved to be uniform by idly rotating the developing roller 42, and the electrostatic latent image on the photosensitive drum 32*a* can be developed with high quality from starting the image forming operation. Here, as described above, when the image having the density equal to or greater than the set density is formed by using the toner of black (K) on the trailing end portion of the record sheet of the final page, the developing roller 42 of the developing cartridge 37*k* is idly rotated again even before starting the successive developing operation after standby and therefore, although the developing roller 42 may be rotated by only one rotation such that the thickness, the charge amount or the like of the toner on the outer peripheral face 42*a* becomes uniform, in consideration of the efficiency of charging the toner of black (K), so far as time is permitted, it is preferable to rotate the developing roller 42 by two rotations or more.

In this way, according to the first embodiment, the developing roller 42 of the developing cartridge 37*k* is not at standby while being stopped to stay to produce the nonuniformity in the thickness or the charge amount of the toner on the outer peripheral face 42*a*, and the developing roller 42 can idly be rotated after finishing the image forming operation (developing operation), or before starting the successive image forming operation producing such a nonuniformity. Therefore, the developing roller 42 of the developing cartridge 37*k* can start successive development by being at standby in the state in which the toner is adhered uniformly on the outer peripheral face 42*a* to charge, even when the standby time period is short, the electrostatic latent image on the photosensitive drum 32*a* can be developed by the toner with higher quality by the toner of black (K).

The second embodiment of the invention will be explained in reference to the FIG. 5 through 7B as follows.

Figure 5:
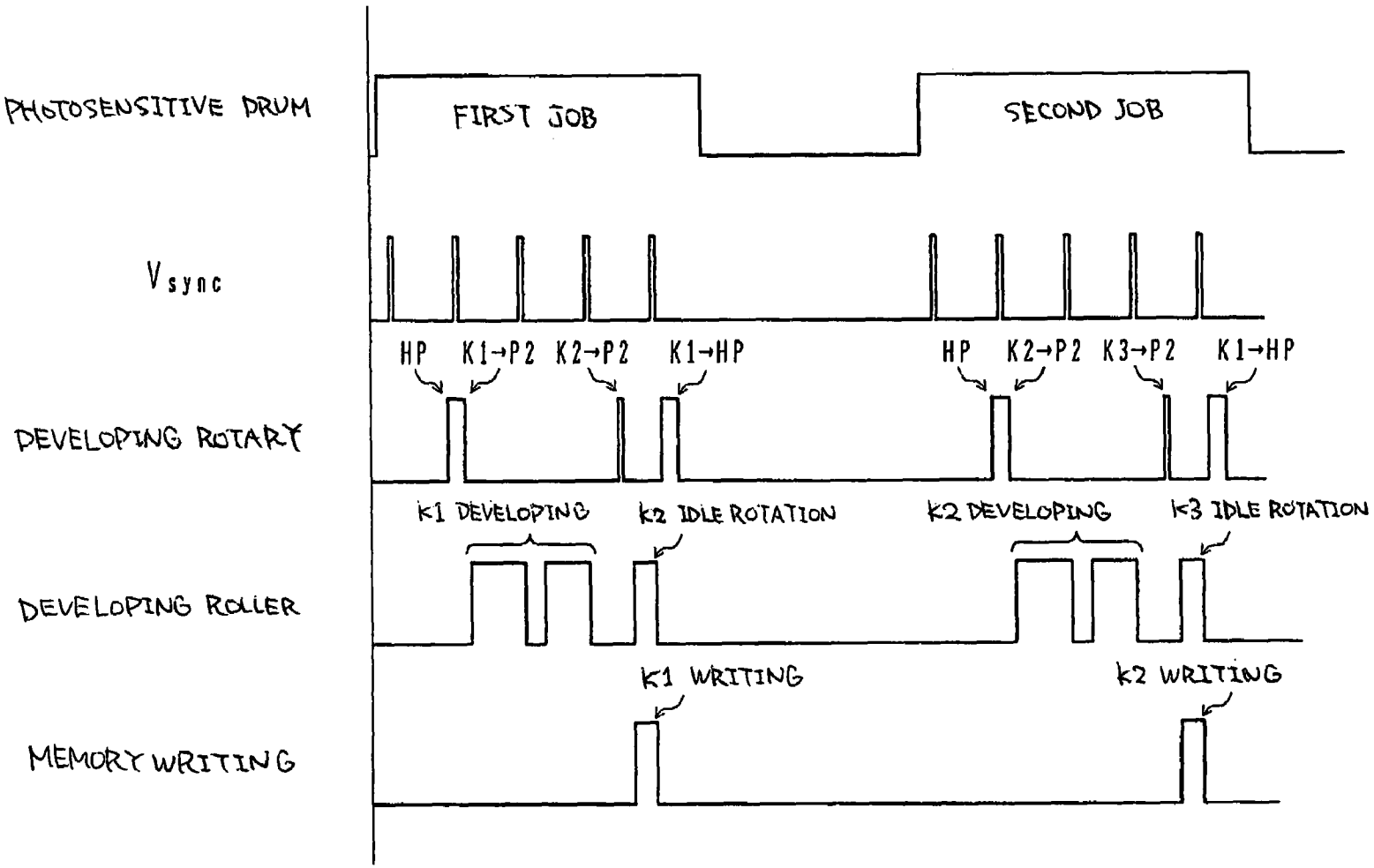
FIG. 5 is a timing chart for explaining a drive control thereof.

When 4 pieces of the developing cartridges 37 containing the toner of the same color of black (K) are mounted to the developing rotary unit 33, at each time of receiving instruction of printing image data for forming a monochrome image, as shown by FIG. 5, CPU 13 forms a high quality image on record sheet via the intermediate transferring belt 34 by forming a uniform toner image on the photosensitive drum 32*a* by driving to rotate the developing roller 42, the supply roller 43 or the like by a previously set drive timing while rewriting various information stored in the involatile memory 46 by successively switching the developing cartridges 37 mounted to the developing rotary unit 33. That is, CPU 13 constitutes an information rewriting unit, and rewrites the information stored in the involatile memory 46 of the developing cartridge 37 that finishes the developing operation by rotating the developing rotary unit 33 in the counterclockwise direction by 90 degrees, and in the operation of rewriting the involatile memory 46, there is brought about the state in which the developing roller 42 of the successive developing cartridge 37 is opposed to the photosensitive drum 32*a* to be able to operate to rotate and the developing roller 42 is idly rotated before executing the developing operation in forming the successive image.

Figure 6A:
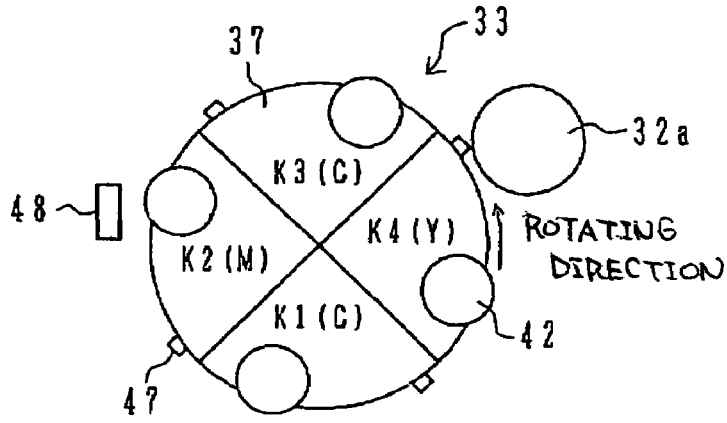
FIGS. 6A to 6C illustrate state views showing a position of rotating a developing rotary unit in the drive control of FIG. 5.

Specifically, when the developing operation is at standby in which CPU 13 does not receive image data from the controller potion 11, as shown in FIG. 6A, the developing rotary unit 33 is disposed at a home position (HP), at the position, similar to the case of containing the developing cartridges 37 for containing a plurality of colors of toners to be able to form the color image, the developing roller 42 of the developing cartridge 37K1 containing the toner of black (K) is rotated in the counterclockwise direction substantially by 120 degrees from the developing position P2 opposed to the photosensitive drum 32*a* (constituting an attitude of toppling the developing cartridge 37K1), and there is brought about the state in which the developing rollers 42 or the like of all of the developing cartridges 37 are disengaged from the drive gear train. Here, when the developing cartridges 37 are mounted in the developing rotary unit 33 to be able to form the color image, FIG. 6A illustrates the developing cartridge 37 of the toner of black (K) as K1, similarly, illustrates the developing cartridge 37 of the toner of magenta (M) as K2, illustrates the developing cartridge 37 of the toner of cyan (C) as K3 and illustrates the developing cartridge 37 of the toner of yellow (Y) as K4.

Figure 6B:
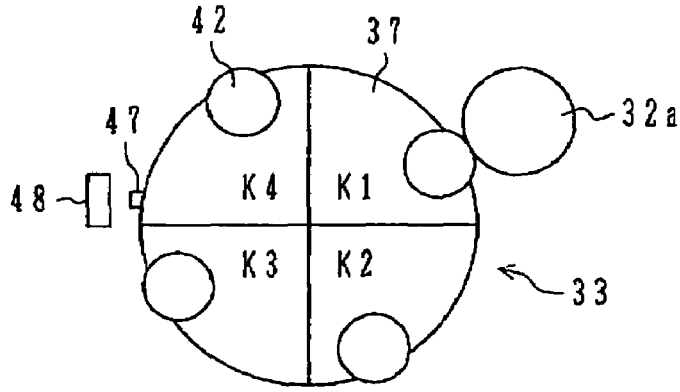

When at standby time, CPU 13 receives instruction of printing image data for forming to record a monochrome image on the record sheet from the controller potion 11, successive to starting to drive the photosensitive drum 32*a* and the intermediate transferring belt 34 and the like, CPU 13 drives the developing roller 42 to synchronize the developing operation by the developing cartridge 37 to a sensor signal (Vsync) from the sensor 56 for detecting the projected piece (shim) of the intermediate transferring belt 34. At this operation, in the image forming operation immediately before standby, when the image is formed (developed) by using the developing cartridge 37K4, first, as shown in FIG. 6B, the developing rotary unit 33 rotates the developing cartridge 37K1 contiguous to the developing cartridge 37K4 from the home position to the developing position P2 opposed to the photosensitive drum 32*a* in the counterclockwise direction, after bringing the developing roller 42 and the like in mesh with the drive gear train at the developing position P2, the developing roller 42 is driven to rotate and the toner on the outer peripheral face 42*a* is adhered to the electrostatic latent image on the photosensitive drum 32*a* to develop the image by the toner.

Figure 6C:
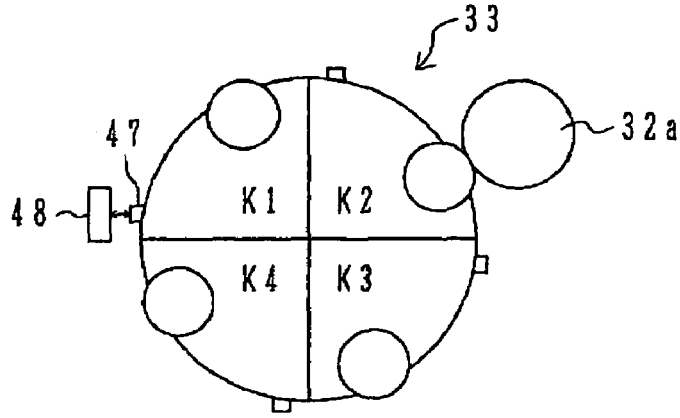

When the CPU 13 receives instruction of printing the successive image data before finishing the developing operation by using the developing cartridge 37K1, in other words, before finishing to form the image, CPU 13 connects to process the instruction as it is as the first job and continuously prints the monochrome image by using the developing cartridge 37K1 as it is without rotating the developing rotary unit 33. At this operation, as shown in FIG. 5, when CPU 13 finishes the developing operation by the developing cartridge 37K1 by constituting the first job by forming the image on two sheets of the record sheet, as shown in FIG. 6C, CPU 13 rotates the developing rotary unit 33 by 90 degrees in the counterclockwise direction, causes the developing side connector 47 of the developing cartridge 37K1 to be opposed to the control side connector 48 on the main body side to be able to communicate in noncontact and rewrites the information stored in the involatile memory 46 by summing up a time period of driving the developing roller 42 and an amount of consuming the toner. Further, in that case, the successive developing cartridge 37K2 contiguous to the developing cartridge 37K1 is disposed at the developing position P2 opposed to the photosensitive drum 32*a* and therefore, in parallel with operation of rewriting the information stored in the involatile memory 46 of the developing cartridge 37K1, CPU 13 drives to rotate (idly rotate) the developing roller 42 of the developing cartridge 37K2 disposed at the developing position P2 to refresh and replenish the toner on the outer peripheral face 42*a*.

Thereby, even in standby time of a short period of time, after developing the final page in the image forming operation even when there is brought about the nonuniformity in the thickness, the charge amount or the like of the toner on the outer peripheral face 42*a* of the developing roller 42 of the developing cartridge 37K2 to be used successively, before starting the image forming operation of image data to be received after standby, previously, the nonuniformity in the toner can be resolved to be uniform by idly rotating the developing roller 42, and the electrostatic latent image on the photosensitive drum 32*a* can be developed with high quality from starting the image forming operation. Here, although the developing roller 42 of the developing cartridge 37 may be rotated only by one rotation such that the thickness, the charge amount or the like of the toner on the outer peripheral face 42*a* becomes uniform, in consideration of the efficiency of charging the toner of black (K), when time is permitted, it is preferable to rotate the developing roller 42 by two rotations or more.

Thereafter, CPU 13 rotates the developing rotary unit 33 in the counterclockwise direction to shift to the standby state by moving to the home position shown in FIG. 6A at which the developing roller 42 of the developing cartridge 37K1 is toppled at the lowest position.

Figure 7A:
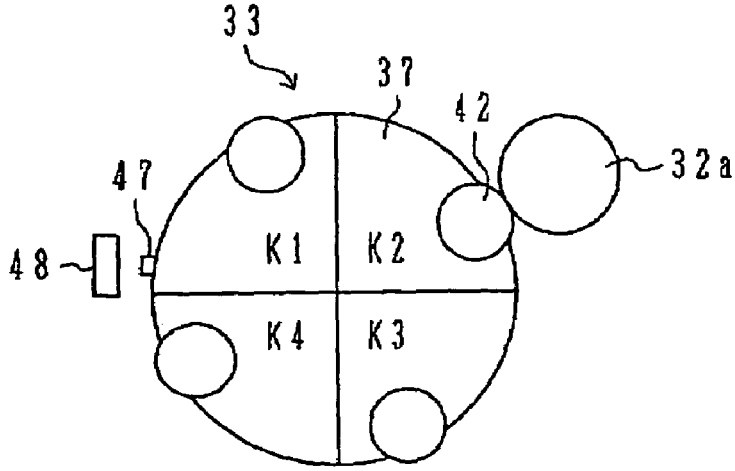
FIGS. 7A and 7B illustrate state views showing a position of rotating the developing rotary unit in the drive control of FIG. 5.

Further, when at the standby time, CPU 13 receives the instruction of printing image data for forming to record the monochrome image on the record sheet from the controller potion 11, as shown in FIG. 5, similarly, in the image forming operation immediately before standby, the image has been formed (developed) by using the developing cartridge 37K1 and therefore, first, as shown in FIG. 7A, the developing rotary unit 33 rotates the developing cartridge 37K2 contiguous to the developing cartridge 37K1 in the counterclockwise direction from the home position to the developing position P2 opposed to the photosensitive drum 32*a*, the developing roller 42 and the like are brought in mesh with the drive gear train, thereby, the toner on the outer peripheral face 42*a* is adhered to the electrostatic latent image on the photosensitive drum 32*a* to develop the image by the toner by driving to rotate the developing roller 42.

Figure 7B:
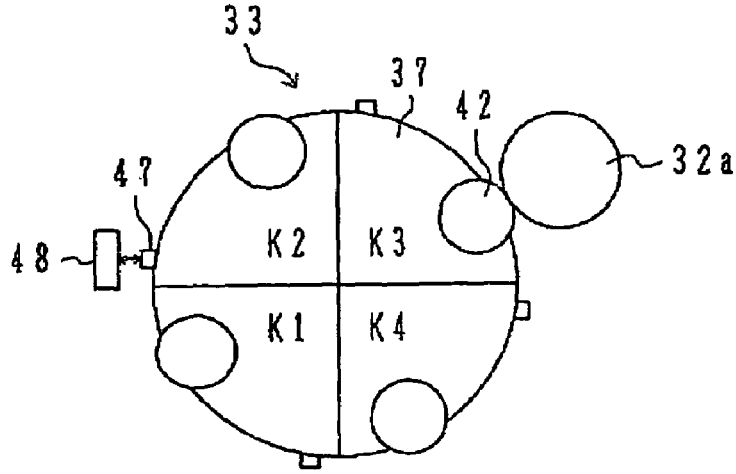

Further, when the image has been finished to form (developing operation by the developing cartridge 37K2) on two sheets of the record sheet of the second job, as shown in FIG. 7B, in parallel with rewriting information stored in the involatile memory 46 of the developing cartridge 37K2 via the connectors 47, 48 by rotating the developing rotary unit 33 by 90 degrees in the counterclockwise direction, by driving to rotate (idly rotate) the developing roller 42 of the developing cartridge 37K3 to be used successively, CPU 13 replenishes and refreshes the toner on the outer peripheral face 42*a* and thereafter shifts to the standby state by moving to the home position shown in FIG. 6A.

Therefore, even when there is nonuniformity in the thickness, the charge amount or the like of the toner on the outer peripheral face 42*a* by developing the image by the toner about the final rotation of the developing roller 42, before starting to develop the image by using the developing roller 42, by idly rotating the developing roller 42 beforehand, the toner can uniformly be adhered onto the outer peripheral face 42*a* to enable to bring about a state in which the image is developed by the toner with high quality. Idle rotation of the developing roller 42 can be carried out in parallel with operation of rewriting the information stored in the involatile memory 46 of the developing cartridge 37 contiguous in the direction of rotating the developing rotary unit 33 without particularly ensuring an exclusive time period, and the electrostatic latent image on the photosensitive drum 32*a* can be developed with high quality from starting the operation of forming the successive image.

In this way, according to the second embodiment, even when the monochrome image is continuously printed repeatedly by mounting 4 pieces of the developing cartridges 37 containing the toner of black (K) to the developing rotary unit 33, the developing roller 42 of the developing cartridge 37 can be rotated idly before starting the operation of forming the successive image without starting operation of forming (developing) the successive image as it is by bringing the developing roller 42 of the developing cartridge 37 at standby (stationary) to stay to produce the nonuniformity in the thickness or the charge amount of the toner on the outer peripheral face 42*a*. Therefore, the developing roller 42 of the developing cartridge 37 can be made to be at standby in a state in which the toner is adhered uniformly onto the outer peripheral face 42*a* to charge, even when the standby time period is short, the electrostatic latent image on the photosensitive drum 32*a* can be developed with the toner with high quality by the toner of black (K).

As other mode of the above embodiments, a toner may be executed to refresh and replenish as in the embodiments in accordance with other condition. In sum, the nonuniformity in the thickness or the charge amount of the toner of black (K) adhered onto the outer peripheral face 42*a* of the developing roller 42 of the developing cartridge 37*k* poses the problem, for example, when the characteristic of charging the toner is deteriorated since temperature or humidity constituting the surrounding environment is very high, or when the characteristic of the toner is deteriorated by containing the toner in the developing cartridge 37 to be brought into press contact by the developing roller 42 and the supply roller 43 repeatedly over a long period of time, such nonuniformity is liable to be produced and therefore, when threshold levels of the conditions are exceeded, the toner of the embodiments may be refreshed or replenished or a set revolution number of the developing roller in the control operation may be increased.

Specifically, when a sensor of temperature or humidity is provided and temperature or humidity of the surrounding environment detected by the sensor exceeds a threshold level thereof, or when a number of times of mounting or a number of times of recycling the developing cartridge 37*k* stored in the involatile memory 46 exceeds a threshold level thereof, and a charging characteristic is deteriorated by absorbing humidity by prolonging a time period of being exposed to outside air, or a time period of driving the developing roller 42 or an amount of consuming the toner exceeds a threshold level thereof and the charging characteristic by friction is deteriorated, CPU 13 executes idle rotation of the developing roller 42 by determining that there is a possibility of being brought into a state in which the toner cannot uniformly be adhered onto the outer peripheral face 42*a* of the developing roller 42.

That is, in this case, the temperature or humidity sensor or CPU 13 functions as a acquiring unit for acquiring information of deterioration of the toner, the developing roller 42 of the developing cartridge 37*k* can idly be rotated, the contained toner is not deteriorated by idly rotating the developing roller 42 indiscreetly, when the characteristic of charging the toner is deteriorated, by uniformly adhering the toner onto the outer peripheral face 42*a* by idly rotating the developing roller 42, the high quality toner development can be executed.

Although an explanation has been given of the embodiments of the invention, the invention is not limited to the above-described embodiments but may naturally be embodied by variously different modes within the range of the technical thought.

Further, although an explanation has been given by taking an example of the case of the image forming apparatus for forming the image by setting a plurality of the developing cartridges 37 to the developing rotary unit 33 and transferring the toner image formed on the photosensitive drum 32*a* on the record sheet via the intermediate transferring belt 34, the invention is not limited thereto but the invention is naturally applicable also to an apparatus of transferring to form the toner image from the photosensitive drum directly on the record sheet.

Further, although an explanation has not particularly given to the above-described embodiments, when the apparatus is left for a long period of time as described in JP-A-2004-126089, it is naturally preferable to realize the high quality toner development by idly rotating the developing roller 42 of the developing cartridge 37.

For example, although according to the above-described first embodiment, when the image is formed on the trailing end side of the record sheet of the final page immediately before standby, the developing roller 42 of the developing cartridge 37*k* is idly rotated at both of timings after finishing to form the image and before starting to form the successive image, the invention is not limited thereto but the developing roller 42 may naturally be rotated idly only at either one of the timings.

For example, although according to the above-described second embodiment, the developing roller 42 of the successive developing cartridge 37 disposed at the developing position P2 is idly rotated in executing operation of rewriting the information stored in the involatile memory 46 contiguous to the developing cartridge 37 which has been used immediately before standby, the invention is not limited thereto but the invention is preferably applicable also to a case in which the position of rewriting the information stored in the involatile memory 46 is arranged at a diagonal position of the developing position P2.

Further, although according to the above-described second embodiment, the developing roller 42 of the developing cartridge 37 is idly rotated before standby, the invention is not limited thereto but the developing roller 42 of the developing cartridge 37 used may naturally be rotated idly immediately before starting the image forming operation.

Further, although according to the above-described second embodiment, an explanation has been given of the case of continuously printing the monochrome image repeatedly by mounting 4 pieces of the developing cartridges 37 containing the toner of black (K) to the developing rotary unit 33, also in the case of forming the color image, the developing roller 42 of the developing cartridge 37 may idly be rotated at timing(s) of either one or both of after finishing to form the image and before starting to form the successive image.

What is claimed is:

1. An image forming apparatus forming an image corresponding to image data on a medium being transported, the image forming apparatus comprising:

an image carrier on which an electrostatic latent image associated with the image data is formed;

a developer comprising:

a container containing toner;

a roller facing the image carrier and causing the toner to adhere onto the image carrier to develop the electrostatic image with the toner as the image; and an applier applying the toner to the roller; and a controller operable to receive the image data and to control the roller in correspondence to the image data, wherein the image data includes first image data corresponding to a first image and second image data corresponding to a second image, the first image is formed onto a trailing end portion of the medium, the controller receives the second image data after the formation of the first image, after the formation of the first image and before the formation of the second image, the controller causes the roller to rotate without causing the toner to adhere onto the image carrier, and when toner density of the first image is greater than a predetermined value, the controller causes the roller to rotate without causing the toner to adhere onto the image carrier in association with the information.

2. The image forming apparatus according to claim 1, wherein the trailing end portion of the medium is substantially as long as a circumference of the roller.

3. An image forming apparatus forming an image corresponding to image data on a medium being transported, the image forming apparatus comprising:

an image carrier on which an electrostatic latent image associated with the image data is formed;

a developer comprising:

a container containing toner;

a roller facing the image carrier and causing the toner to adhere onto the image carrier to develop the electrostatic image with the toner as the image; and an applier applying the toner to the roller; and a controller operable to receive the image data and to control the roller in correspondence to the image data, wherein the image data includes first image data corresponding to a first image and second image data corresponding to a second image, the first image is formed onto a trailing end portion of the medium, the controller receives the second image data after the formation of the first image, after the formation of the first image and before the formation of the second image, the controller causes the roller to rotate without causing the toner to adhere onto the image carrier, the controller comprises an acquirer acquiring information related to deterioration of the toner, and the controller causes the roller to rotate without causing the toner to adhere onto the image carrier in association with the information.

4. The image forming apparatus according to claim 1, wherein the controller causes the roller to rotate at least one time without causing the toner to adhere onto the image carrier.

5. An image forming apparatus forming an image corresponding to image data on a medium being transported, the image forming apparatus comprising:

an image carrier on which an electrostatic latent image associated with the image data is formed;

a developer comprising:

a container containing toner;

a roller facing the image carrier and causing the toner to adhere onto the image carrier to develop the electrostatic image with the toner as the image; and an applier applying the toner to the roller; and a controller operable to receive the image data and to control the roller in correspondence to the image data, wherein the image data includes first image data corresponding to a first image and second image data corresponding to a second image, the first image is formed onto a trailing end portion of the medium, the controller receives the second image data after the formation of the first image, after the formation of the first image and before the formation of the second image, the controller causes the roller to rotate without causing the toner to adhere onto the image carrier, the controller comprises an acquirer acquiring information related to color of the toner, and the controller causes the roller to rotate without causing the toner to adhere onto the image carrier in association with the information.

6. An image forming apparatus forming an image corresponding to image data on a medium being transported, the image forming apparatus comprising:

an image carrier on which an electrostatic latent image associated with the image data is formed;

a plurality of developers associated with a plurality of colors, each of which comprising:

a container containing toner having one of the colors;

a roller facing the image carrier and causing the toner to adhere onto the image carrier to develop the electrostatic image with the toner as the image; and an applier applying the toner to the roller;

a development unit configured to be rotatable around an rotational axis thereof, the development unit detachably housing a plurality of the developer around the rotational axis; and a controller operable to receive the image data and to control the roller in correspondence to the image data, wherein the image data includes first image data corresponding to a first image and second image data corresponding to a second image, the controller receives the second image data after the formation of the first image, after the formation of the first image and before the formation of the second image, the controller causes the roller to rotate without causing the toner to adhere onto the image carrier when the first image includes a prescribed one of the colors, and when toner density of the first image is greater than a predetermined value, the controller causes the roller to rotate without causing the toner to adhere onto the image carrier in association with the information.

7. The image forming apparatus according to claim 6, wherein the image forming apparatus is operable to form the image in a monochrome mode and a color mode, and the color is used in the monochrome mode.

8. The image forming apparatus according to claim 6, wherein the first image is formed onto a trailing end portion of the medium.

9. The image forming apparatus according to claim 8, wherein the trailing end portion of the medium is substantially as long as a circumference of the roller.

10. An image forming apparatus forming an image corresponding to image data on a medium being transported, the image forming apparatus comprising:

an image carrier on which an electrostatic latent image associated with the image data is formed;

a plurality of developers associated with a plurality of colors, each of which comprising:

a container containing toner having one of the colors;

a roller facing the image carrier and causing the toner to adhere onto the image carrier to develop the electrostatic image with the toner as the image; and an applier applying the toner to the roller;

a development unit configured to be rotatable around an rotational axis thereof, the development unit detachably housing a plurality of the developer around the rotational axis; and a controller operable to receive the image data and to control the roller in correspondence to the image data, wherein the image data includes first image data corresponding to a first image and second image data corresponding to a second image, the controller receives the second image data after the formation of the first image, after the formation of the first image and before the formation of the second image, the controller causes the roller to rotate without causing the toner to adhere onto the image carrier when the first image includes a prescribed one of the colors, the controller comprises an acquirer acquiring information related to deterioration of the toner, and the controller causes the roller to rotate without causing the toner to adhere onto the image carrier in association with the information.

11. The image forming apparatus according to claim 6, wherein the controller causes the roller to rotate at least one time without causing the toner to adhere onto the image carrier.

12. An image forming apparatus forming an image corresponding to image data on a medium being transported, the image forming apparatus comprising:

an image carrier on which an electrostatic latent image associated with the image data is formed;

a plurality of developers, each of which comprising:

a container containing toner;

a roller facing the image carrier and causing the toner to adhere onto the image carrier to develop the electrostatic image with the toner as the image;

an applier applying the toner to the roller; and a memory rewritably storing first information;

a development unit configured to be rotatable around an rotational axis thereof, the development unit detachably housing a plurality of the developer around the rotational axis; and a controller operable to receive the image data and to control the roller in correspondence to the image data and comprising a rewriter operable to rewrite the first information, wherein the controller causes first one of the plurality of developers not to face the image carrier and causes second one of the plurality of developers to face the image carrier, the controller causes the second one of the plurality of developers to rotate without causing the toner to adhere onto the image carrier and the rewriter rewrites the first information stored in the memory of the first one of the plurality of developers, the controller comprises an acquirer acquiring second information related to deterioration of the toner, and the controller causes the roller to rotate without causing the toner to adhere onto the image carrier in association with the second information.

13. The image forming apparatus according to claim 12, wherein the image data includes first image corresponding to a first image and second image data corresponding to a second image, the controller receives the second image data after the formation of the first image, the first one of the plurality of developers is associated with the first image, and the second one of the plurality of developers is associated with the second image.

14. The image forming apparatus according to claim 12, wherein the first one of the plurality of developers is adjacent to the second one of the plurality of developers in a rotating direction of development unit, and the first one of the plurality of developers faces the image carrier before the second one of the plurality of developers faces the image carrier.

15. The image forming apparatus according to claim 12, wherein the controller causes the roller to rotate at least one time without causing the toner to adhere onto the image carrier.

* * * * *